United States Patent [19]

Johannsen

[11] Patent Number: 4,538,382

[45] Date of Patent: Sep. 3, 1985

[54] APPARATUS FOR SHARPENING A KNIFE BLADE OR THE LIKE

[75] Inventor: Donald R. Johannsen, Dearborn, Mich.

[73] Assignee: Bonni S. Carris, Detroit, Mich.

[21] Appl. No.: 557,193

[22] Filed: Dec. 1, 1983

[51] Int. Cl.[3] ..... B24B 3/52

[52] U.S. Cl. ..... 51/69; 51/211 R; 76/82.2

[58] Field of Search ..... 51/69, 211, 211 H; 76/82, 82.2; 269/3; 24/489

[56] References Cited

U.S. PATENT DOCUMENTS

| | | | |
|---|---|---|---|
| 1,105,473 | 7/1914 | Walker | 269/3 |
| 1,619,581 | 3/1927 | Long | 76/82.2 |
| 1,852,667 | 4/1932 | Neel | 51/211 H |
| 2,638,805 | 5/1953 | Bigelow | 269/3 |
| 3,733,933 | 5/1973 | Longbrake . | |
| 3,819,170 | 6/1974 | Longbrake . | |
| 3,920,235 | 11/1975 | Hermanns | 269/238 |
| 4,084,299 | 4/1978 | Noda | 24/489 |
| 4,170,343 | 10/1979 | Longbrake . | |
| 4,216,627 | 8/1980 | Westrom | 51/69 |
| 4,320,892 | 3/1982 | Longbrake . | |
| 4,404,873 | 9/1983 | Radish | 269/3 |
| 4,418,588 | 12/1983 | Byers | 76/82.2 |
| 4,441,279 | 4/1984 | Storm | 51/69 |
| 4,471,951 | 9/1984 | LeVine | 51/69 |

OTHER PUBLICATIONS

Brochure LS Lansky Sharpeners, 1982, by Arthur Lansky Le Vine & Associates, Inc.

Brochure LS Lansky Sharpeners, "The Sharpest Investment You May Ever Make!", 1982, by Arthur Lansky Le Vine & Associates, Inc.

LS Lansky Sharpeners, "Help You Coming and Going", 1 page.

E-Z Sharp Knife Sharpener Model '80, "The Simple Sharpening System", Rossville, Illinois, 1 page.

The Art of Getting A Perfect Edge Everytime With Your LS Lansky Sharpener System, 1 page.

Thank You . . . and Congratulations-You Now Own the "Simple System" For Precision Knife Sharpening . . . Enjoy It!, 1 page.

*Primary Examiner*—Harold D. Whitehead

*Attorney, Agent, or Firm*—Harness, Dickey & Pierce

[57] ABSTRACT

An improved apparatus for sharpening the cutting edge of a knife blade or other cutting implement including a frame assembly having clamping means for securing the blade thereto and guide means for maintaining an abrading means or an abrading assembly in a substantially constant angular relationship with the blade. The apparatus also includes means for accommodating a variety of blade sizes and thicknesses as well as means for performing abrading operations varying from coarse to fine on the blade without changing or rotating the abrading assembly. Handle means are also provided and include shield means for protecting the hands of the user.

19 Claims, 3 Drawing Figures

APPARATUS FOR SHARPENING A KNIFE BLADE OR THE LIKE

BACKGROUND AND SUMMARY OF THE INVENTION

The invention relates generally to an apparatus for sharpening knife blades or other cutting implements, and more particularly to such an apparatus which is manually operable and has an abrading assembly that is slidably movable in engagement along the knife blade or other cutting implement for abradingly forming a sharpened cutting edge portion thereon.

Various devices have been provided for forming a sharpened cutting edge portion on a knife blade or other cutting implement and are available in a wide variety of types and configurations. Many of such devices are powered by electric current and thus suffer the disadvantage of being unusable in remote areas where electric power is not available. Other prior sharpening devices are manually operated, but are frequently expensive and relatively cumbersome to use.

With regard to other prior sharpening devices that are portable and lightweight, it is known to use a pair of separate gripping fingers to clamp a knife blade to be sharpened, with the fingers being clamped together via a fastener assembly. In the present invention, however, the fingers are pivotally hinged together to facilitate handling. In addition a resilient member urges and holds the two gripping fingers apart to assist in the insertion of the blade between the fingers. The fingers are also provided with confronting ridges, which define a stop, and locating surfaces which assist in aligning the blade to be sharpened.

In the present invention, the gripping fingers are part of a frame assembly. A separate abrading means (which includes abrading members on a support rod) is pivotally and slidably engageable with guide means on the frame assembly for guiding and maintaining the abrading means in a substantially constant angular relationship with the cutting edge as the abrading means is moved along the cutting edge. Preferably, the sharpening apparatus of the present invention includes means for altering or adjusting the angular relationship between the abrading means and the cutting edge in order to accommodate cutting implements of various sizes or configurations while still maintaining a substantially constant angular relationship between the abrading means and the cutting implement during sharpening. The preferred abrading means comprises an abrading assembly having a number of axially aligned abrading members on a single rod, each of which has a different grit or coarseness in order to allow the user to initially perform relatively coarse abrading operations on the cutting edge portion of the cutting implement and to finish the sharpening operation with a relatively fine abrading member, thereby achieving a smooth, sharp cutting edge. Since the abrading members are axially aligned on a single rod the sharpening operation can be completed without the need to use a plurality of abrading means and with a minimum amount of manipulation of the support rod.

Since the apparatus is operated manually, one of the objectives of the present invention is to provide such a shield-like structure wherein the user's hands are substantially protected from the cutting edge being sharpened. As will be seen, by locating the abrading members in axial alignment, the shield can be made substantially wide to enhance protection of the operator's hand.

The preceding are some of the features of the present invention. Additional objects, advantages, and features of the present invention will become apparent from the following description and appended claims, taken in conjunction with the accompanying drawings.

DETAILED DESCRIPTION OF THE PREFERRED EMBODIMENTS

Figure 1:
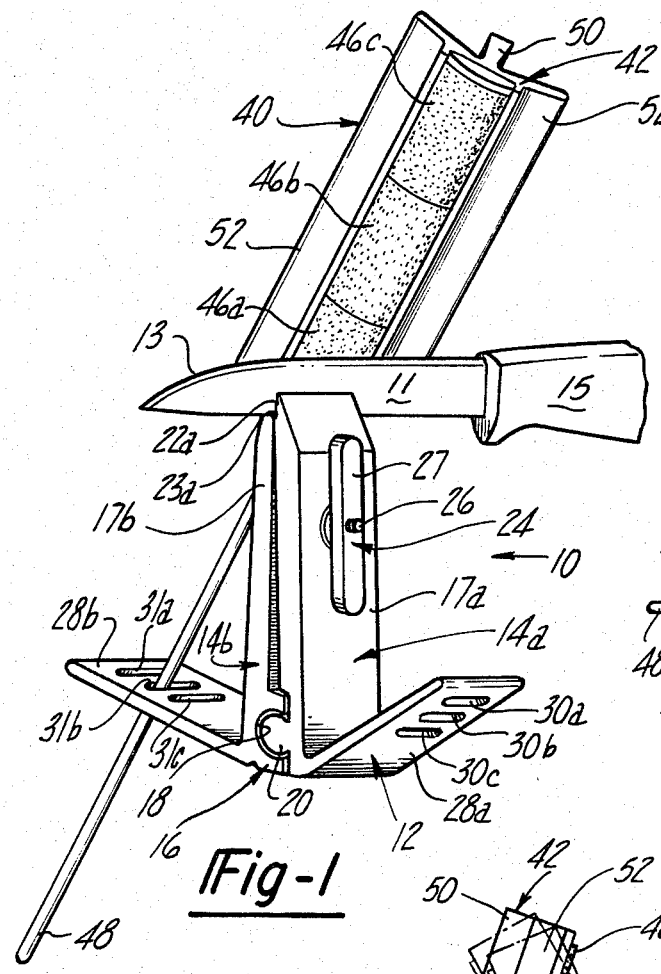
FIG. 1 is a perspective view of an apparatus for sharpening a cutting implement according to the present invention.
Figure 2:
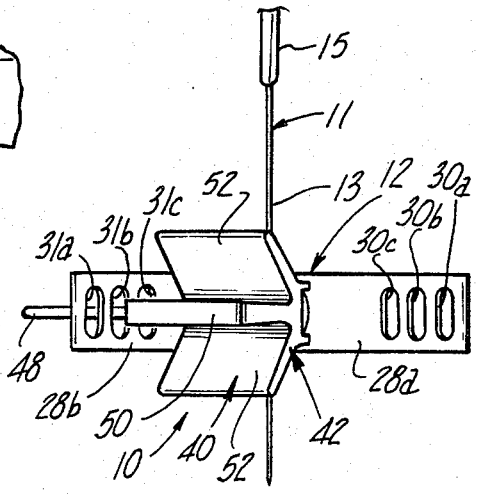
FIG. 2 is a top view of the sharpening apparatus of FIG. 1.
Figure 3:
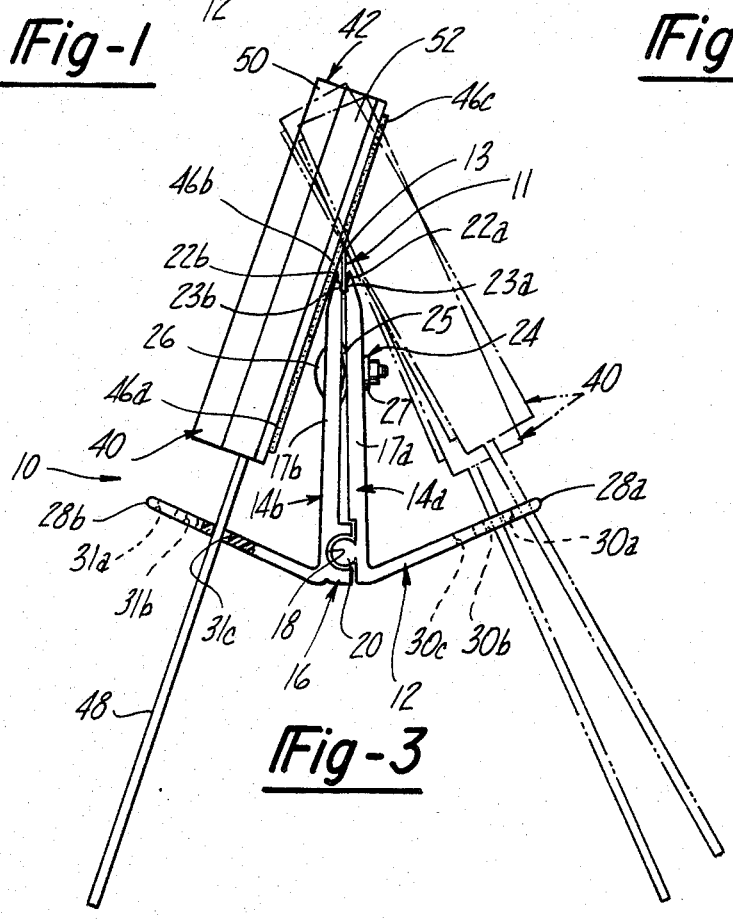
FIG. 3 is an end view, partially broken away in cross-section, of the sharpening apparatus of FIG. 1, illustrating various positions of the abrading assembly engaged or interconnected with the guide means thereof.

FIGS. 1 through 3 of the drawings illustrate an exemplary preferred embodiment of an apparatus according to the present invention for sharpening a knife blade or other cutting implement. One skilled in the art will readily recognize from the drawings and the following discussion that the principles of the invention are equally applicable to a sharpening apparatus other than that shown for purposes of illustration in the drawings.

As illustrated in FIGS. 1 through 3, a sharpening apparatus 10 according to the present invention is illustrated in use for sharpening a knife blade 11 or other cutting implement in order to form a sharpened cutting edge portion 13. The sharpening apparatus 10 includes a frame assembly 12, preferably having a pair of clamping members 14*a* and 14*b*, which are pivotally interconnected by a hinge assembly 16. Clamping members 14*a* and 14*b* are provided with elongated clamping finger portions 17*a* and 17*b*, respectively, which are adapted to be pivoted toward and away from each other via the hinge assembly 16. The hinge assembly 16 is formed with an elongated socket portion 18 at the base of finger portion 17*b* of clamping member 14*b* and is adapted to be hingedly interconnected with a complementary elongated pivot pin protrusion 20 at the base of the finger portion 17*a* of the other clamping member 14*a*. As will become readily apparent from the following description, such a hinge assembly configuration allows the clamping members 14*a* and 14*b* to be of a one-piece construction formed by conventional extrusion processes permitting the production of an inexpensive but high quality device.

The clamping members 14*a* and 14*b* are equipped with a threaded fastener assembly 24 including a threaded screw 26 extending through aligned openings in finger portions 17*a* and 17*b*, and threadably engaging a nut 27 for urging the finger portions 17*a* and 17*b* toward one another to clamp the blade 11 therebetween.

The clamping surfaces of the finger portion 17*a* and 17*b* include one or more stepped recessed portions 22*a*, 23*a* and 22*b*, 23*b*, respectively, for abuttingly engaging the backside of the blade 11. The recessed portions 22*a*, 22*b* and 23*a*, 23*b* define stop surfaces or shoulders for locating the blade and for aligning the blade relative to the sharpening apparatus 10. A resilient spring-type wavy washer 25, or other biasing means, is provided for biasing the finger portions 17*a* and 17*b* away from one another in order to facilitate easy and convenient insertion of the blade 11 into the space between them prior to actuation of the threaded fastener assembly 24 or other securing means.

The clamping members 14*a* and 14*b* also include guide members 28*a* and 28*b*, respectively, which are integral with the clamping members and which extend generally transversely and outwardly at acute angles in opposite directions from the bases of finger portions 17*a* and 17*b*, respectively. The guide members 28*a* and 28*b* include a plurality of elongated guide openings 30*a*, through 30*c* and 31*a* through 31*c*, respectively. The guide members 28*a* and 28*b* are adapted to be engaged by, or pivotally interconnected with, an abrading assembly 40 as described below.

The abrading assembly 40 generally includes a body portion 42 having one or more hone or abrading members 46*a*, 46*b* and 46*c* thereon. An elongated rod-like member 48 extends in a generally parallel or colinear direction from the body portion 42 and is adapted to be inserted into any of the preselected guide openings 30*a* through 30*c*, or 31*a* through 31*c*, on either of the guide members 28*a* or 28*b* in a pivotal engagement or interconnection therewith. By inserting the rod-like member 48 into a preselected guide opening 30*a* through 30*c*, or 31*a* through 31*c*, the abrading members 46 may be slidably engaged with the cutting edge portion 13 of the blade 11 and slidably moved back and forth along and/or across the blade in order to abradingly sharpen the cutting edge 13. As shown in FIG. 3, in phantom lines, the rod-like member 48 of the abrading assembly 40 may be inserted into the appropriate one of the guide openings to accommodate the size, height, and configuration of the blade 11 or other cutting implement being sharpened. Although the guide openings may have any of a number of suitable shapes, it is preferred that they are elongated as shown in the drawings in order to provide for a substantial amount of pivotal travel of the abrading assembly 40 back and forth along and/or across the cutting edge 13 during the abrading operation.

It should be noted that regardless of which of the elongated guide opening 30*a* through 30*c*, or 31*a* through 31*c*, on either of the guide members 28*a* or 28*b*, the angular relationship between the abrading members 46 and the blade 11 is maintained substantially constant during the slidable abrading movement of the abrading assembly 40 along and/or across the blade 11 for a given preselected guide opening. This allows for sharpening the cutting edge portion 13 on the blade 11 in a generally uniform manner. A plurality of abrading members 46*a*, 46*b*, and 46*c*, having different degrees of coarseness or grit are provided on the single abrading assembly 40 in order to allow the user to initially perform relatively coarse sharpening operations on the cutting edge 13 and progressively perform finer sharpening operations in order to form a smooth sharp cutting edge 13. Thus only one abrading assembly 40 is required to perform the complete sharpening operation. It should also be noted that the plurality of abrading members are disposed longitudinally in line, in a generally end-to-end relationship with one another, as shown in the drawings and preferably have their abrading (blade engaging) surfaces oriented generally in the same direction. Thus the abrading assembly 40 need only be moved longitudinally to permit use of the different abrading members 46*a* through 46*c*.

As illustrated in the drawings, the guide members 28*a* and 28*b* are formed at an appropriate angle with the respective finger portions 17*a* and 17*c*, and hence with the blade 11, such that the rod-like member 48 forms an approximately 90-degree angle with the guide members 28*a* and 28*b* when inserted into any of the guide openings 30*a* through 30*c*, or 31*a* through 31*c* when the abrading members 46*a*, 46*b*, or 46*c* abradingly engage the cutting edge 13. Such a relationship facilitates a generally smooth and unrestricted pivotal engagement between the rod-like member 48 and the selected guide opening 30*a* through 30*c*, or 31*a* through 31*c*.

The body portion 42 of the brading assembly 40 also includes an elongated rib on the opposite side thereof from the abrading members 46*a* through 46*c*, which defines a handle portion 50 being adapted to be gripped by the user of the sharpening apparatus 10. In order to protect the user's hands or other gripping means from injury or damage resulting from contact with the cutting edge 13, the body portion 42 includes one or more shield portions 52 disposed generally between the handle portion 50 and the abrading members 46*a* through 46*c*. It should be noted that the shield portions 52 extend for a substantial distance outwardly from the handle portion 50 in order to protect the user's fingers which are gripping the handle portion 50. In one form of the invention the shield portions 52 extend outwardly or laterally from the handle portion 50 a distance that is at least equal to the width of the abrading members 46*a* through 46*c*. It can also be seen that the shield portions 52 are formed at an angle with the handle portion 50 so as to be inclined rearwardly away from the abrading members 46*a* through 46*c*. This inhibits or minimizes the possibility of contact between the shield portions 52 with the cutting edge 13 during the sharpening operation. It also minimizes the possibility of contact between the operator's hands and the cutting edge 13 in the event that his or her hands slip off the handle portion 50. In this regard, the handle portion 50 is preferably tapered, as shown in FIG. 1, so that its rearward edge is thicker than its forward edge so that if the operator's fingers slip on the handle portion 50, they tend to slip toward the rearward side of the shield portions 52 where they are shielded from the cutting edge 13.

Furthermore, in order to facilitate safe and convenient sharpening operations, the sharpening apparatus 10 is designed and configured so that once the blade 11 is secured between the clamping fingers 17*a* and 17*b*, the user may maintain the blade 11 and the frame assembly 12 in a stationary position merely by securely gripping the handle 15 of the cutting implement. It should be noted that because of the above-mentioned longitudinal end-to-end relationship of the abrading members, progressive abrading operations may be performed without moving the user's hands on either the abrading assembly or the knife.

From the above discussion, one skilled in the art will readily recognize that the present invention provides a sharpening apparatus which can be safely used and operated, which accommodates various sizes, thicknesses and configurations of blades or other cutting implements to be sharpened, and which conveniently allows for relatively coarse, intermediate, and/or relatively fine abrading operations on the cutting edge of the blade without the necessity of a plurality of abrading assemblies.

The foregoing discussion discloses and describes exemplary embodimemnts of the present invention. One skilled in the art will readily recognize from such discussion that various changes, modifications and variations may be made therein without departing from the spirit and scope of the invention as defined in the following claims.

What is claimed is:

1. An apparatus for manually sharpening a cutting implement, said apparatus comprising:

a frame assembly having securing means thereon for removably securing said cutting implement in a fixed position relative to said frame assembly; abrading means including a plurality of abrading members engageable with said cutting implement and slidably movable with respect to said cutting implement during said engagement for abradingly forming a sharpened cutting edge portion thereon; said abrading means including an elongated body portion, an elongated rod-like member connected to said elongated body portion and being pivotally engageable with said frame assembly, said plurality of abrading members secured to said body portion with each having an abrading surface of a different coarseness and further being selectively engageable with said cutting implement at said substantially constant angular relationship therewith during the slidable movement relative thereto, said abrading members being secured to said body portion in longitudinal alignment with each other with their abrading surfaces oriented generally in the same direction; and said abrading means including handle means on a rearward side thereof adapted to be gripped by a user and shield means disposed generally between said handle means and said abrading member, said shield means extending laterally outwardly from said handle means a distance at least equal to the lateral width of said abrading member, said shield means extending in a direction to be generally rearward of each of said abrading surface.

2. An apparatus according to claim 1, wherein said shield means is inclined at an angle relative to said handle means and extends rearwardly generally away from said abrading member.

3. An apparatus according to claim 1, further including guide means on said frame portion fixed relative to said securing means for guidingly maintaining said abrading means in a substantially constant angular relationship with said cutting implement during the slidable movement of said abrading means in order to form a generally uniform sharpened cutting edge portion on said cutting implement, said abrading means being engageable with said guide means at any of a number of preselectable positions thereon, each of said positions corresponding to a preselected angular relationship with said cutting implement, said guide means guidingly maintaining the preselected angular relationship substantially constant during the slidable movement of said abrading means.

4. An apparatus according to claim 3, wherein said guide means includes a pair of said guide members protruding from said frame assembly on opposite sides of said cutting implement, each of said guide members having a number of said guide openings extending therethrough, said elongated member of said abrading means being selectively insertable in any of said guide openings in order to selectively alter the angular relationship between said abrading means and said cutting implement.

5. An apparatus according to claim 1, wherein said securing means comprises a pair of clamping members adapted to receive said cutting implement therebetween, pivot means connecting said clamping members for pivotal movement between opened and closed positions, said securing means further including tightening means actuable for urging said clamping members toward said closed position to clampingly engage opposite sides of said cutting implement, said securing means including biasing means comprising a wavy washer spring for biasing said clamping members toward said opened position to facilitate insertion of said cutting implement therebetween prior to actuation of said tightening means.

6. An apparatus according to claim 5, wherein said clamping members have clamping surfaces facing generally toward one another, each of said clamping surfaces having a stepped recessed portion comprising a plurality of steps thereon for receiving cutting implements of various thickness inserted therebetween, each of said steps defining a recess with a stop surface for locating and positioning the cutting implement at a preselected position within said frame assembly.

7. An apparatus according to claim 6, further comprising fastener means actuable for urging said clamping members toward one another to clampingly engage opposite sides of said blade, and resilient biasing means comprising a wavy washer for biasing said clamping members away from each other in a spaced-apart relationship in order to facilitate insertion of said blade therebetween prior to actuation of said fastener means.

8. An apparatus for manually sharpening a knife blade or the like, said apparatus comprising:

a pair of clamping members pivotally connected to one another for clampingly engaging said blade therebetween;

a pair of guide members extending from said clamping members in generally opposite transverse directions relative to said blade, each of said guide members having at least one guide opening extending therethrough; and an abrading assembly having at least one abrading member thereon and including an elongated rod-like member, said rod-like member being selectively insertable into either of said guide openings in pivotal engagement with the respective one of said guide members, said abrading member being slidably movable in engagement along a cutting edge portion of said blade, said guide member maintaining said abrading member in a sustantially constant angular relationship with said blade during said slidable movement in order to form a generally uniform sharpened cutting edge portion on said blade, said abrading assembly including a plurality of said abrading members having abrading surfaces thereon, each of said abrading members being of a different coarseness and further being selectively engageable with said blade at said substantially constant angular relationship therewith during the slidable movement relative thereto, said abrading members being disposed in a generally longitudinal end-to-end relationship with one another and having their abrading surfaces oriented generally in the same direction, said abrading assembly including an elongated body member secured to one end of said rod-like member, said body member having a front surface with a longitudinally extending groove therein, said abrading members supported in said groove and having working surfaces extending forwardly in clearance with the confines of said front surface and of said elongated body member, said body member having guard members extending substantially outwardly transversely from opposite sides of said body member and located rearwardly of said working surfaces of said abrading members.

9. An apparatus according to claim 8, wherein each of said guide members includes a number of said guide openings extending therethrough at outwardly spaced-apart locations thereon, said rod-like member being selectively insertable into any of said guide openings in either of said guide members in order to selectively alter said angular engagement of said abrading members with said blade.

10. An apparatus for manually sharpening a knife blade or the like, said apparatus comprising:

a pair of generally similarly shaped clamping members pivotally interconnected with one another, resilient biasing means for resiliently biasing said clamping members away from one another in a spaced-apart relationship in order to facilitate insertion of said blade therebetween at one end of said clamping members, securing means actuable for urging said clamping members toward one another to clampingly secure said blade therebetween;

a pair of generally similarly shaped guide members integrally formed with a corresponding one of said clamping members and extending generally in opposite outward directions on opposite sides of said clamping members, said guide members having a plurality of elongated guide openings therethrough;

pivot means on said clamping members located at the end of said clamping members opposite said one end, said securing means comprising a releasable fastener assembly connected between said clamping members at a position between said one and opposite ends of said clamping members;

an abrading assembly having at least one hone member thereon, said hone member having an abrading surface, said abrading assembly further including a rod-like member selectively insertable into any of said elongated guide openings in pivotal engagement with either of said guide members, said hone member being slidably movable in engagement along a cutting edge portion of said blade, said guide members being adapted to maintain said hone member in a substantially constant angular relationship with said blade during the slidable movement when said rod-like member is inserted in a preselected one of said guide openings in order to form a generally uniform sharpened cutting edge portion on said blade.

11. An apparatus according to claim 10, with said abrading assembly including a plurality of hone members of different grits located longitudinally in line with each other and wherein said rod-like member is at an approximately 90-degree angle with either of said guide members when said rod-like member is inserted into any of said elongated guide openings extending therethrough and one of said hone members is in engagement with said blade.

12. An apparatus according to claim 10, wherein said abrading assembly includes a handle member extending from the side of said abrading assembly opposite from said honing members and adapted to be gripped by a user, and shield members extending generally in opposite directions between said handle member and said hone members, said handle member having a width substantially less than the extension of said shield members therefrom.

13. An apparatus according to claim 10, wherein said clamping members have clamping surfaces facing generally toward one another, each of said clamping surfaces having a plurality of stepped recessed portions thereon for accommodating knife blades of various thicknesses inserted therebetween.

14. An apparatus for manually sharpening a knife blade or the like, said apparatus comprising:

a pair of clamping members, said clamping members having clamping surfaces at one end thereof for clampingly engaging said blade therebetween;

hinge means for pivotally interconnecting said clamping members, said hinge means being located generally at the opposite end of said clamping members from said clamping surfaces, said hinge means including an integral pin-like protrusion on one of said clamping members and an integral socket portion on the other of said clamping members, said socket portion being adapted to freely axially receive and to radially interlockingly hold said pin-like protrusions to define a hinge connection for pivotal movement between said clamping members;

fastener means connected to said clamping members at a location between said clamping surfaces and said hinge means and being selectively actuable for urging said clamping members pivotally toward one another in order to clampingly engage said blade between said clamping surfaces;

at least one guide member extending from one of said clamping members in a generally transverse direction relative thereto, said guide member having at least one guide opening extending therethrough; and an abrading assembly having an elongated body portion with at least one abrading member thereon and further including an elongated rod-like member secured to said body portion, said rod-like member insertable into said guide opening in pivotal engagement with said guide member, said abrading member being slidably movable in engagement along a cutting edge portion of said blade.

15. An apparatus according to claim 14, wherein one of said guide members is integrally formed with each of said clamping members.

16. An apparatus according to claim 14, further comprising resilient biasing means including a wavy spring washer for biasing said clamping members away from each other in a spaced-apart relationship in order to facilitate insertion of said blade therebetween prior to actuation of said fastener means.

17. An apparatus according to claim 14, wherein said abrading assembly includes a handle member on said body portion extending oppositely from said abrading member and adapted to be gripped by a user, and shield members extending generally in opposite directions between said handle member and said abrading members.

18. An apparatus according to claim 17, wherein the thickness of said handle member increases in a direction generally away from said shield members.

19. An apparatus according to claim 17 with said abrading assembly including a plurality of abrading members secured to said body portion in longitudinal alignment with each other.

* * * * *

UNITED STATES PATENT AND TRADEMARK OFFICE

CERTIFICATE OF CORRECTION

PATENT NO. : 4,538,382

DATED : September 3, 1985

INVENTOR(S) : Donald R. Johannsen

It is certified that error appears in the above-identified patent and that said Letters Patent is hereby corrected as shown below:

Column 8, Claim 14, line 42, after "member" insert

-- being --.

Signed and Sealed this

*Tenth* Day of *December 1985*

[SEAL]

*Attest:*

DONALD J. QUIGG

*Attesting Officer*

*Commissioner of Patents and Trademarks*